United States Patent [19]

Premel et al.

[11] Patent Number: 4,694,782

[45] Date of Patent: Sep. 22, 1987

[54] PROCESS AND APPARATUS FOR PRODUCING HIGH-PRESSURE AND SUPERHEATED STEAM

[75] Inventors: Ulrich Premel; Rolf Dorling; Manfred Schultze, all of Gummersbach, Fed. Rep. of Germany

[73] Assignee: L. & C. Steinmüller GmbH, Gummersbach, Fed. Rep. of Germany

[21] Appl. No.: 811,497

[22] Filed: Dec. 20, 1985

[30] Foreign Application Priority Data

Dec. 22, 1984 [DE] Fed. Rep. of Germany ..... 3447265

[51] Int. Cl.[4] ..... F22D 1/00

[52] U.S. Cl. ..... 122/7 R; 122/406 S; 122/470

[58] Field of Search ..... 122/7 R, 406 S, 406 ST, 122/4 R, 470

[56] References Cited

U.S. PATENT DOCUMENTS

| | | | |
|---|---|---|---|
| 4,018,267 | 4/1977 | Tomasicchio | 122/379 X |
| 4,262,636 | 4/1981 | Augsburger | 122/406 ST |
| 4,352,341 | 10/1982 | Styslinger | 122/7 R |
| 4,430,962 | 2/1984 | Miszak | 122/406 S |

*Primary Examiner*—Edward G. Favors

*Attorney, Agent, or Firm*—Becker & Becker, Inc.

[57] ABSTRACT

With a process for producing high-pressure superheated steam via hot reaction gases of a gas generator, in which coal or carbon containing materials are gasified, the production of the high-pressure superheated steam is effected in the gas generator and in a waste heat system. The gas generator preferably is provided with at least two integrated vaporizers, especially a radiation vaporizer and a radiation vaporizer and a radiation superheater.

42 Claims, 2 Drawing Figures

PROCESS AND APPARATUS FOR PRODUCING HIGH-PRESSURE AND SUPERHEATED STEAM

FIELD OF THE INVENTION

The invention relates to a process and an apparatus for producing high-pressure and superheated steam by means of hot reaction gases from a gas generator in which coal or carbon containing materials are gasified.

BACKGROUND OF THE INVENTION

Description of the Prior Art

According to processes known until now, the reaction gases, which accumulate in a gas generator lined with brick after termination of the gasification reaction of coal or carbon containing materials, are fed to a waste heat system connected at the outlet side of a pressure vessel, saturated steam preferably being produced in the waste heat system. The pressure stage of this known waste heat system in the form of a water-tube or fire-tube boiler is generally between 40 and 120 bar. The gas produced in this way is utilized within a larger process or within several process cycles in which the gas generator and the waste heat system are frequently connected in series with a chemical plant in which the generated synthesis gas is further processed.

When using gasification reactors and waste heat systems in connection with steam generators, the live steam conditions produced by the waste heat system, however, are essentially greater than in the above mentioned known waste heat system. In this process it concerns a connection between a known steam turbine process and a gas turbine process, in which there is a special advantage in an essential increase of efficiency. If a gas generator with a waste heat system is integrated in such a combination process, there is, regarding the utilization of waste heat to generate steam, a requirement to produce high-pressure, superheated steam which can be supplied to the or several steam turbine(s) together with the steam generated in a steam generator block of conventional design. This may be effected in the intermediary or end stage. In the course of further development, the pressures and temperatures of the operating media are very considerably increased during generation of high-pressure and superheated steam in power plant processes. In order to obtain a high efficiency, the power plants are in most cases operated with live steam conditions of more than 530° C. and pressures of more than 200 bar. The live steam generated in a waste heat system of a coal gasification plant therefore must have the same steam parameters in this combination process.

BRIEF SUMMARY OF THE INVENTION

It is therefore an object of the invention to provide a process and to suggest an apparatus, by means of which high-pressure, superheated live steam can be generated in a very simple and economical manner by means of hot, dust laden reaction gases of a gas generator having a temperature up to 550° C. and a below or super critical pressure.

According to the invention there is provided a process for producing high-pressure and superheated steam by means of hot reaction gases of a gas generator in which coal or carbon containing materials are gasified, characterized in that the production of the high-pressure, superheated steam is effected in the gas generator and in a waste heat system.

According to a preferred embodiment of the invention, the high-pressure, superheated steam is generated in the gas generator with waste heat system in at least two successive stages, whereby the steam is generated in the first stage in a radiation vaporizer and in a vaporizer located behind the reactor brick lining, and subsequently in a second stage flows through a radiation superheater. In certain loading conditions the steam is already slightly superheated in the vaporizer behind the reactor brick lining.

In another preferred embodiment of the invention the radiation vaporization is effected in several stages, preferably in two stages.

Furthermore, it is advantageous if a further superheating stage, preferably a convection superheating stage, is connected as an end stage at the outlet side of the radiation superheater in the gas generator.

In order to separate from the steam the liquid or the water carried along with the steam, in a further embodiment of the invention the high-pressure steam leaving the first stage is passed over a water separator before it is passed to the radiation superheater in the second stage. This manner of operation applies to the partial loading region. In the loading region 50–130%, the steam generator can be operated once-through in the waste heat system, and in the loading region <50%, in forced rotation.

In yet a further preferred embodiment of the invention a pressure resistant valve is provided on the side of steam-water between the vaporizer and the separating vessel. This valve enables the vaporizer to be operated supercritically. Any steam pressure can be adhered to in the superheating stages.

In order to keep reaction gases of the gas generator free from gasification residues, in a further preferred embodiment of the invention the reaction gases of the gas generator are substantially freed from solid before traversing the end stage in the form of a convection superheater.

In still a further preferred embodiment of the invention the heating surfaces are subjected to a mechanical cleaning of dust. The cleaning of the heating surfaces may be effected in a simple manner by means of a conventional mechanically or pneumatically operated beating device.

BRIEF DESCRIPTION OF THE DRAWINGS

Further details, features and advantages of the invention are apparent from the following description of the process variants with reference to the drawings.

DETAILED DESCRIPTION OF THE PREFERRED EMBODIMENT

Figure 1:
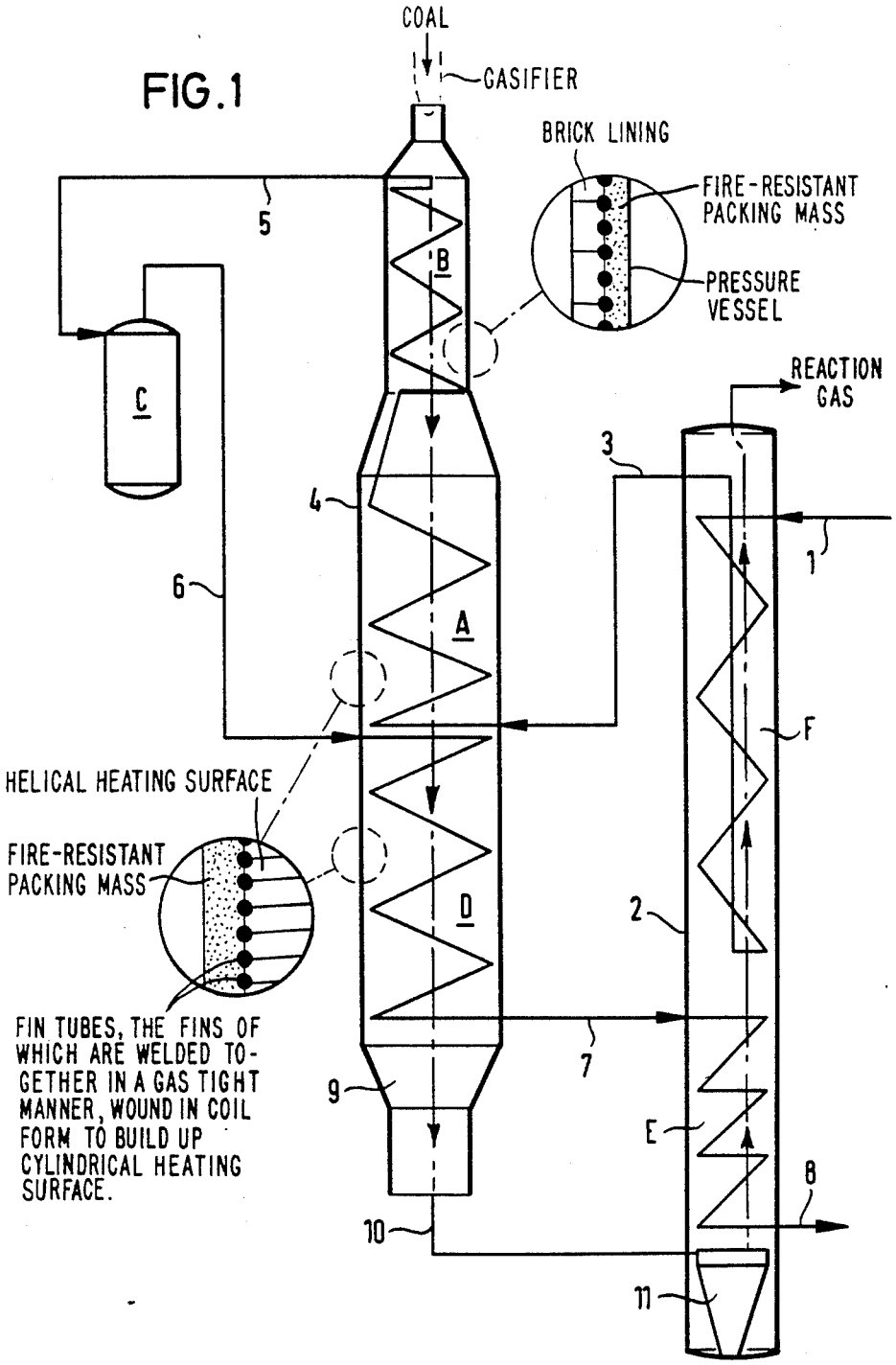
FIG. 1 is an arrangement according to the invention of a gas generator with waste heat system and one-stage radiation vaporizer.

As can be seen in FIG. 1, feed water is preheated through a pressure line 1 to generate steam in a heat-exchanger F in the form of a convection preheater located in a pressure vessel 2, and is supplied to a radiation vaporizer A disposed in a gas generator 4 through a pressure line 3, where it vaporizes by means of hot reaction gases which are produced by gasification of coal or carbon containing materials. The feed water which is vaporized in the radiation vaporizer 4 at high pressure and high temperature leaves in the form of superheated steam after traversing vaporizer B located behind the brick lining of the gas generator 4. This superheated steam is fed to a separating vessel C through a pressure line 5, in which vessel separation of water carried alongwith the steam takes place for low-power operation. After traversing the separating vessel C which acts as a separator, the high-pressure, superheated steam arrives through a further pressure line 6 in a radiation superheater D disposed below the radiation vaporizer A. The radiation superheater D is connected on the side of the process gas at the outlet side of the radiation vaporizer A. The radiation superheater D is provided with mechanical cleaning devices. A further pressure line 7 passes the high pressure, superheated steam to a second superheating stage E. The end stage E is provided in the vessel 2 in the form of a convection heating surface and is connected in series with the feed water preheater F on the side of the process gas. The convection superheater E is provided with pneumatic beating devices (not shown in the drawing) which enable cleaning.

The high-pressure superheated steam generated in the convection superheater E is discharged for further utilization through a connected pressure line 8 at a temperature of about 550° C. and a pressure of about 185 bar, for example to drive steam turbines.

In the process of the invention, reaction gases having a temperature of about 1500° C. are produced in the gas generator 4 by means of coal or carbon containing residues. After traversing the radiation vaporizer A and the radiation superheater D they still show a temperature of about 800° C. To control the high heat flow densities at the outlet of the radiation chamber 9, it is necessary that the reaction gases in this region are cooled by means of a further heating surface. The reaction gas leaving the gas generator 4 through the processing gas line 10 is subjected in the pressure vessel 2 to a gas cleaning 11 before it traverses the convection superheater E. It is then substantially freed from solids, for example by means of a cyclone separator.

Figure 2:
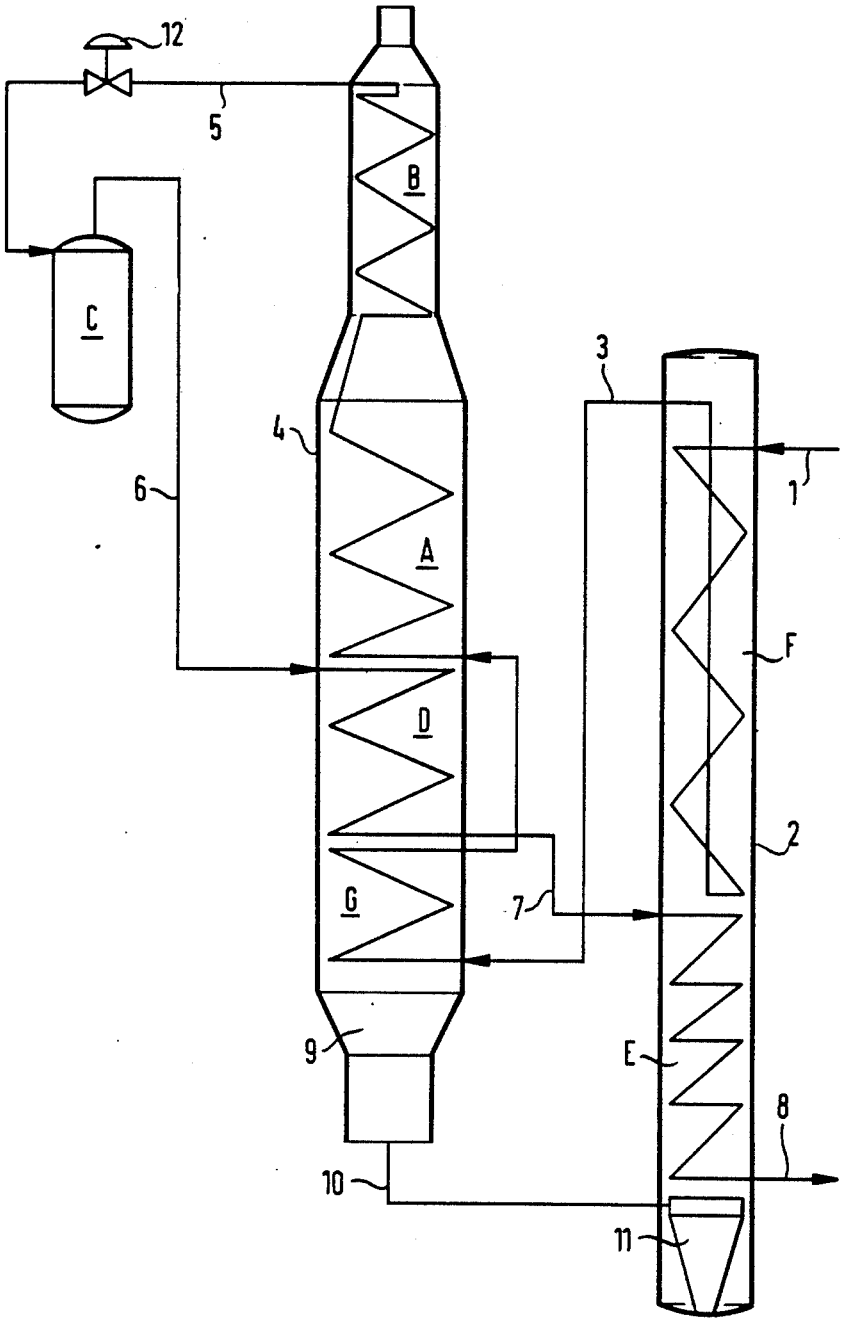
FIG. 2 is an arrangement according to the invention of a gas generator with waste heat system and two-stage radiation vaporizer and pressure resistant valve.

As shown in FIG. 2, according to the present invention it is also possible, in the gas generator 4 after the reaction chamber, to provide the first portion of the radiation cooler in the form of a vaporizer G, and the second portion in the form of a superheater D above which the radiation vaporizer A is then disposed. Moreover, the radiation vaporizer may have any number of stages. Also, according to FIG. 2 a pressure resistant valve 12 is incorporated in the pressure line 5 in order to be able to operate the vaporizer supercritically and the superheater with any pressure.

In order to achieve uniform heating, the heating surfaces are preferably coiled. From a certain inclination of the vaporizer tubes, it is required to operate the vaporizer with supercritical pressure. In the vaporizer region, the separation process, and the different heat transers to the inside of the tube associated therewith, are counteracted in this manner.

Heating surfaces are subjected to mechanical dust cleaning. A radiation vaporizer and radiation super heater comprise extruded Cr/Ni fin tubes. The gas generator 4 is in a pressure vessel; a fire-resistant packing mass is disposed between the cylindrical heating surfaces and pressure vessel.

The gas generator 4 includes a gasifier and, near the latter, a brick lining support comprising cooling elements that on the side of steam and water are integrated in a once-through circulation.

The gas generator 4 includes a reactor having a brick lining behind which is disposed a gastight vaporizer heating surface that, even when the brick lining fails, enabls safe operation of the reactor, thus increasing operating time.

The present invention is, of course, in no way restricted to the specific disclosure of the specification and drawings, but also encompasses any modifications within the scope of the appended claims.

What we claim is:

1. A process for producing high-pressure and superheated steam by means of hot reaction gas from a gas generator in which coal or carbon-containing materials are gasified; said process includes the steps of:

producing said high-pressure, superheated steam in said gas generator and in a waste heat system;

said producing step comprises producing said steam in at least two successive stages, including, in a first stage, producing said steam in a radiation vaporizer, and in a subsequent second stage, conveying said steam through a radiation superheater;

providing a further superheating stage, in the form of an end stage, at the outlet side of said radiation superheater in said gas generator; and providing a convection superheater as said further superheating stage, and disposing said convection superheater in a vessel separate from said gas generator.

2. A process according to claim 1, which includes the steps of: disposing a further vaporizer after the fire-resistant lining of said gas generator to form a cooling surface, and conveying said steam from said radiation vaporizer of said first stage through said further vaporizer prior to conveying said steam through said radiation superheater.

3. A process according to claim 1, which includes the step of effecting said radiatioin vaporization in at least two stages.

4. A process according to claim 1, which includes the step of operating the heating surfaces of said vaporizer at supercritical pressure.

5. A process according to claim 1, which includes the step of conveying said steam from said first stage through a water separator prior to conveying said steam through said second stage.

6. A process for producing high-pressure and superheated steam by means of hot reaction gas from a gas generator in which coal or carbon-containing materials are gasified; said process includes the steps of:

producing said high-pressure, superheated steam in said gas generator and in a waste heat system;

said producing step comprises producing said steam in at least two successive stages, including, in a first stage, producing said steam in a radiation vaporizer, and in a subsequent second stage, conveying said steam through a radiation superheater;

conveying said steam from said first stage through a water separator prior to conveying said steam through said second stage; and disposing a pressure resistant valve between said vaporizer of said first stage and said water separator, on the side of the steam and water, in order to enable supercritical operation of said vaporizer.

7. A process according to claim 6, which includes the step of providing a further superheating stage, in the form of an end stage, at the outlet side of said radiation superheater in said gas generator.

8. A process for producing high-pressure and superheated steam by means of hot reaction gas from a gas generator in which coal or carbon-containing materials are gasified; said process includes the steps of:

producing said high-pressure, superheated steam in said gas generator and in a waste heat system;

said producing step comprises producing said steam in at least two successive stages, including, in a first stage, producing said steam in a radiation vaporizer, and in a subsequent second stage, conveying said steam through a radiation superheater;

providing a further superheating stage, in the form of an end stage, at the outlet side of said radiation superheater in said gas generator; providing a convection superheater as said end stage, and extensively freeing the reaction gases from said gas generator of gasification residue prior to conveying said gases to said convection superheater.

9. A process according to claim 6, which includes the step of subjecting heating surfaces to mechanical dust cleaning.

10. A process according to claim 6, which includes the step of selectively operating the steam generator in said waste heat system in a once-through and forced circulation manner.

11. A process according to claim 6, which includes the step of operating said radiation superheater in direct current.

12. A process according to claim 6, which includes the steps of providing ac convection superheater as said end stage, and operating the latter in reverse current.

13. An apparatus for producing high-pressure and superheated steam by means of hot reaction gas from a gas generator in which coal or carbon-containing materials are gasified; said apparatus comprises:

a gas generator having at least two integrated vaporizers, including a radiation vaporizer and a radiation superheater; a pressure vessel that is separate from said gas generator and is interconnected with the latter via a processing gas line, a first pressure line for feed water, and a second pressure line for steam; disposed in a lower portion of said pressure vessel is a convection heating surface having an outlet side on the side of the waste gas; disposed at said outlet side of said convection heating surface a feed water preheater in the form of a convection preheater; and said pressure vessel includes a gas cleaning device disposed below said convection heating surface.

14. An apparatus according to claim 13, which includes a further vaporizer connected to the outlet side of said radiation vaporizer in said gas generator.

15. An apparatus according to claim 14, which includes two radiation vaporizers in said gas generator, with said radiation superheater being disposed between the two.

16. An apparatus according to claim 14, which includes a water separator disposed externally of said gas generator between said further vaporizer and said radiation superheater.

17. An apparatus according to claim 13, in which said radiatio superheater and said convection heating surface are provided with cleaning devices.

18. An apparatus according to claim 13, in which said radiation vaporizer and said radiation superheater comprise gastight, helically coiled, cylindrical heating surfaces.

19. An apparatus according to claim 13, in which said radiation vaporizer and said radiation superheater comprise extruded Cr/Ni fin tubes.

20. An apparatus according to claim 18, in which said gas generator is in a pressure vessel; and in which a fire-resistant packing mass is disposed between said cylindrical heating surfaces and said pressure vessel.

21. An apparatus according to claim 13, in which said gas generator includes a gasifier and, near the latter, a brick lining support comprising cooling elements that on the side of steam and water are integrated in a once-through circulation.

22. An apparatus according to claim 13, in which said gas generator includes a reactor having a brick lining behind whih is disposed a gastight vaporizer heating surface that, even when said brick lining fails, enables safe operation of said reactor, thus increasing operating time.

23. A process for producing high-pressure and superheated steam, said process including the steps of:

gasifying coal or carbon-containing material under pressure in a gas generator, and thereby generating a stream of dust-laden reaction gas;

producing steam in at least two successive stages in said gas generator including, in a first stage, producing said steam in a radiation vaporizer from preheated water and superheating said steam in a second stage by passing it through a radiation superheater;

further superheating said steam in a third stage by passing it through a convection superheater; and preheating said water in a convection preheater;

said reaction gas being passed subsequently through said radiation vaporizer, said radiation superheater, said convection superheater and said convection preheater.

24. A process according to claim 23, which includes the steps of:

disposing a further vaporizer behind a brick lining with respect to said reaction gas stream and conveying said steam from said first stage through said further vaporizer prior to conveying said steam through said radiation superheater.

25. A process according to claim 23, which includes the step of effecting said radiation vaporization in at least two stages.

26. A process according to claim 23, which includes the steps of:

conveying said preheated water from said convection preheater to a second radiation vaporizer prior to conveying said water to said first radiation vaporizer, said reaction gas being passed subsequently through said first radiation superheater, said second radiation vaporizer and said convection superheater.

27. A process according to claim 23, which includes the step of disposing said convection superheater and said convection preheater in a vessel separate from said gas generator.

28. A process according to claim 23, which includes the steps of:

conveying said steam from said first stage through a water separator prior to conveying said steam through said second stage and disposing a pressure holding valve between said radiation vaporizer of said first stage and said water separator in order to enable operation of said vaporizers at supercritical pressure.

29. A process according to claim 23, which includes the step of extensively freeing said reaction gas of gasification residue in dust form prior to conveying said reaction gas to said convection superheater.

30. A process according to claim 23, which includes the step of operating said radiation superheater in direct current.

31. A process according to claim 23, which includes the step of operating the convection superheater in reverse current.

32. An apparatus for producing high-pressure and superheated steam, said apparatus comprises:

a gas generator including a pressure vessel for gasifying coal or carbon-containing material under pressure and generating a stream of dust-laden reaction gas;

steam generating means for generating steam from preheated water and being integrated in said pressure vessel of said gas generator and including at least a radiation vaporizer and a radiation superheater;

a convection superheater;

a convection preheater for preheating water;

said radiation vaporizer, said radiation superheater, said convection superheater and said convection preheater being passed by said stream of reaction gas in this order.

33. An apparatus according to claim 32, which includes a further vaporizer connected to the outlet side of said radiation vaporizer in said gas generator.

34. An apparatus according to claim 33, which includes two radiation vaporizers in said gas generator, with said radiation superheater being disposed between the two.

35. An apparatus according to claim 33, which includes a water separator disposed externally of said gas generator between said further vaporizer and said radiation superheater and a pressure holding valve disposed between said water separator and said further vaporizer.

36. An apparatus according to claim 32, which includes a pressure vessel that is separate from said gas generator and is interconnected with the latter via a reaction gas line, a first pressure line for preheated water, and a second pressure line for steam; disposed in a lower portion of said pressure vessel is said convection superheater; disposed at the reacting gas outlet side of said convection superheater is said convection preheater; and in which in said pressure vessel is disposed a gas cleaning device disposed below said convection superheater and connected to said reaction gas line.

37. An apparatus according to claim 36, in which said radiation superheater and said convection superheater are provided with cleaning devices.

38. An apparatus according to claim 32, in which said radiation vaporizer and said radiation superheater comprise gastight, helically coiled cylindrical heating surfaces.

39. An apparatus according to claim 32, in which said radiation vaporizer and said radiation superheater comprise extruded Cr/Ni fin tubes.

40. An apparatus according to claim 38, in which a fireresistant packing mass is disposed between said cylindrical heating surfaces and said gas generator pressure vessel.

41. An apparatus according to claim 33, in which said further vaporizer connected to the outlet side of said radiation vaporizer in said gas generator is disposed behind a brick lining of said gas generator, said further vaporizer comprises a gastight heating surface.

42. A process according to claim 23, which includes the step of operating said vaporizer at supercritical pressure.

* * * * *

UNITED STATES PATENT AND TRADEMARK OFFICE

CERTIFICATE OF CORRECTION

PATENT NO. : 4,694,782

DATED : September 22, 1987

INVENTOR(S) : ULRICH PREMEL ET AL

It is certified that error appears in the above-identified patent and that said Letters Patent is hereby corrected as shown below:

On the title page, the following should be added:

[73] and VEW Vereinigte Elektrizitätswerke Westfalen AG
Dortmund, Fed. Rep. of Germany

Signed and Sealed this

Second Day of February, 1988

*Attest:*

*Attesting Officer*

DONALD J. QUIGG

*Commissioner of Patents and Trademarks*